US006158097A

United States Patent [19]

Dilo

[11] Patent Number: 6,158,097

[45] Date of Patent: Dec. 12, 2000

[54] METHOD AND APPARATUS FOR NEEDLING A FIBER FLEECE BY MEANS OF ROTATABLE NEEDLES

[75] Inventor: Johann Philipp Dilo, Eberbach, Germany

[73] Assignee: Oskar Dilo Maschinenfabrik KG, Germany

[21] Appl. No.: 09/311,827

[22] Filed: May 13, 1999

[30] Foreign Application Priority Data

May 20, 1998 [DE] Germany ..... 198 22 736

[51] Int. Cl.[7] ..... D04H 18/00

[52] U.S. Cl. ..... 28/114; 28/107

[58] Field of Search ..... 28/107, 114, 108, 28/109, 110, 111, 113, 115

[56] References Cited

U.S. PATENT DOCUMENTS

| | | | |
|---|---|---|---|
| 3,909,891 | 10/1975 | Dilo | 28/109 |
| 4,856,152 | 8/1989 | Kis | 28/114 |
| 5,226,217 | 7/1993 | Olry et al. | 28/107 |
| 5,649,343 | 7/1997 | Profe | 28/107 |
| 5,699,596 | 12/1997 | Fehrer | 28/107 |
| 5,732,453 | 3/1998 | Dilo et al. | 28/107 |

FOREIGN PATENT DOCUMENTS

| | | | |
|---|---|---|---|
| 1 803 342 | 5/1970 | Germany . | |
| 2 202 127 | 7/1973 | Germany . | |
| 0 151 775 | 11/1981 | Germany | 18/114 |

*Primary Examiner*—Amy B. Vanatta
*Attorney, Agent, or Firm*—Morgan & Finnegan, L.L.P.

[57] ABSTRACT

In a method and apparatus for needling a fiber fleece, the needles are rotated around their own axes at least during their stitching-in motion into the fiber fleece, in order to produce a mutual twisting of fibers within the fiber fleece. In an embodiment of the invention, the needles are moreover moved in parallel to the fiber fleece in two directions orthogonal with respect to one another by drive means which are controllable independently from one another. Thereby, various variation alternatives are provided to influence the formation of stitches.

25 Claims, 3 Drawing Sheets

METHOD AND APPARATUS FOR NEEDLING A FIBER FLEECE BY MEANS OF ROTATABLE NEEDLES

The present invention relates to a method and an apparatus for needling a fiber fleece by means of rotatable needles,

BACKGROUND OF THE INVENTION

German patent 900 056 describes a method of manufacturing cushion webs from a support tissue, e.g. of jute, and a pad layer, e.g. of palm fibers, coconut fibers, hair or the like, in which the attachment strips formed on the lower side of the support tissue by hook needles attached at a needle board are continuously interlinked and/or simultaneously twisted. For this purpose the hook needles are stitched into the fiber layer from the side of the support tissue at a certain rotary position of the needles. In this rotary position the hook points to the transport direction at which the support tissue and fiber layer are moved under the needle board. Finally, the needles are drawn out of the fiber layer and the support tissue in the same rotary position so that the fibers grasped by the hooks form loops which are drawn through the support tissue. Finally, the hook needles are turned in their axis by 180° and after a forward feed of the support tissue together with the fiber layer about a stitching pitch, the needles are again stitched through the support tissue and the fiber layer. Then the needles are again turned back about 180° into their original rotary position and are drawn out of the fiber layer and the support tissue. Thereby they form new fiber loops, which are drawn through the fiber loops formed in the preceding stitching cycle. After feeding the support tissue and its fiber layer about a further stitching length, the fiber loops formed first are fixed on the support tissue by the successively formed fiber loops. The process then repeats cyclically. Thus, a needle rotation only takes place in the conditions in which the hook of the needle has completely left the fiber layer and the support tissue, respectively. According to German patent 904 621 it is also possible by this method to provide mats for pads and the like having linked or twisted holding loops without the arrangement of a support tissue.

Velours and felts can easily be manufactured by means of the needling technique, also in structured design, it is, however, not possible at the moment to manufacture fleeces as thin as a tissue, since a sufficient fiber compound does not result by needling. On the other hand, there is a desire for mechanical methods on the basis of non-weaving, by means of which knitted fabrics or textiles similar to a woven material are to be manufactured, which are at least similar to knitted fabrics and tissues regarding their rigidity and the textile drape and regarding their appearance. This desire exists in view of the fact that a much higher productivity can be achieved by the needling technique than by the knitting or weaving technique. In the needling technique textile webs at production velocities of a some meters of web material per minute can be manufactured, whereas the production velocities during knitting or weaving are only a few centimeters of web material per minute.

U.S. Pat. No. 5,732,453 discloses a needle machine for needling a fiber fleece web, in which two needle bars arranged successively in the fleece transport direction are subjected to a reciprocating up and down motion component by a common drive, said motion component being directed perpendicular with respect to the fleece support. Furthermore, the needle bars may be set via a second drive to a reciprocating motion extending in parallel to the fleece transport direction, so that by superposition of these motions the needle bars can be set in a motion which depending on the extent of the motion strokes is circular or more or less elliptical, when seen transversely to the feed direction and in parallel to the extension of the fleece web.

In co-pending U.S. patent application, Ser. No. 09/098,245 filed by Dilo et al. on Jun. 17, 1998, a needle machine is described, in which two rigidly coupled needle bars in addition to the two motion components described in U.S. Pat. No. 5,732,453 are provided with a third motion component which extends perpendicular to the fleece transport direction, whereby the stitching pattern can further be influenced.

By means of these various possible needle bar movements in three directions orthogonal with respect to one another the stitching pattern can be influenced to a great extent. Some wishes are, however, not fulfilled, in particular in the already described aspect to additionally influence the fiber structure of the ready fleece.

SUMMARY OF THE INVENTION

It is the object of the invention to provide a method and a device of the above-mentioned kind by means a highest possible measure of stitching variation can be achieved.

The invention provides to rotate the needles around their axes during their stitching-in movement, i.e. during penetration into the fiber fleece. Hereby, the needles grip fibers of different layers of the fleece and transport portions of them to other layers of the fleece and also out of the fleece, and generate a twisting of fibers of different layers with one another, which leads to a severe strengthening of the fleece. Thereby it is possible to achieve a sufficient fiber bond also if relatively thin fiber fleeces are used, said fiber bond making the textile product manufactured by the needling process stretch resistant to a certain extent.

In a further development of the invention the needles may in addition to the stitching and rotational movement perform a movement parallel to the fiber fleece in one direction, e.g. a transport direction, if the fiber fleece is a fiber fleece web moved through a needling machine, or possibly also in two directions orthogonal with respect to one another and parallel to the fiber fleece web. Besides the penetration movement component, a total of three further motion components is available for the needling process by means of which the stitching pattern may be influenced.

Since a needle bar, which comprises drive means for the rotation of the needles around their axes, cannot be equipped with needles as densely as a needle bar having fixed needles, the invention can preferably be practiced by a needle machine which comprises a plurality of needles bars which are arranged successively in a fiber fleece web transport direction and which are each equipped with needles, preferably in a manner offset with respect to each other seen in a transport direction of the fiber fleece web and which successively treat the fiber fleece web when transported through the machine at transversely offset locations. In an advantageous development the invention provides that each needle bar or a group of closely spaced needle bars belonging to one or a plurality of needling zones, comprises an individual drive and that all drives are controllable independently from one another. If the needle bar is driven not only in the stitching direction but also in the fleece plane parallel and transversely to the fiber fleece web transport direction, the respective drive means according to the invention are individually associated to the respective needle bar or the needle bar group, so that also this motion component extending transversely to the stitching direction can be influenced individually for the associated needle bar or needle bar group, respectively.

Thus, the needle bars or needle bar groups may be moved individually in three directions orthogonally with respect to one another, and according to the invention which provides a rotation of the needles around their axes, it is also possible in an especially simple manner to produce fiber patterns on the fiber fleece web that are similar to lock stitches. Four drive means are associated to each individual needle bar: The first drive means sets the needle bar in stitching motion, the second drive means generates an oscillating motion component extending in parallel to the fiber fleece web transport direction. It is also possible by this drive to increase the transport speed of the fiber fleece web, since in case of an appropriate timing of the motion component caused by the second drive means, the needles in state stitched into the fiber fleece web follow the fiber fleece web transport motion. The third drive means displaces the needles transversely to the fiber fleece web transport direction, so that the stitching pattern can be influenced to avoid for instance the generation of stripes in the fiber fleece web. The fourth drive means sets the needles in rotation, wherein this rotation may be performed in one single direction or also in reciprocating fashion.

The rotary motion may be programmable, infinitely variable at an angle of 0° to a multiple of 360°, or it may be continuous with an infinitely variable angular speed, or synchronized with the other motion components of the needle bar that is provided to same by the first to third drive means. A rotary needle motion about the needle's own axis is interesting, if the task shall be fulfilled to generate fiber loops which are formed by the needles penetrating the fiber fleece and taking fibers from a plurality of layers of the fleece and twist these fibers with one another by the needle rotation. The rotation may for instance be towards the right during the stitching-in motion and left during the pulling-out motion at a certain angle, wherein for instance the phase of the rotary motion starts when the needle starts penetrating into the fiber fleece web and stops in the lower dead center of the stitching-in motion of the needle, and the needles are turned backwards upon the beginning of the pulling-out motion of the needles. The choice of differently great angles of rotation during penetration and return of the needles is advantageous in some case, in particular to advance the release of the needles from the fibers grasped without disrupting the twisting result.

The control of the plurality of drive means is taken over by a control unit, by means of which the motions caused by the drives at the needle bars can be individually adjusted with regard to mutual phase position and possibly with regard to their amplitude. Synchronous operation of all corresponding drives of all needle bars can also be adjusted.

If successive needle bars stitch into opposite phase into the fiber fleece (phase shift 180°) it is favorable in order to avoid transport problems at the fleece web to shorten the phases in which the needles are stitched-in into the fleece web, so that time sections are generated in which no needles are stitched-in into the fleece web. As an alternative the advantages of the needle bar drive can be utilized, said needle bar drive being described in the above-mentioned U.S. Pat. No. 5,732,453, in order to overcome such transport problems.

A planar brush band or a lamellar grating may be used as a support for the fiber fleece web. In case of a very close spatial arrangement of the needle bars it is favorable to design the fleece support in a roll-like manner. For this purpose, a brush roll may be used or a roll with circumferential ribs with interposed circumferential grooves. A roll of that kind may in an advantageous manner be designed as a disk roll, composed of a plurality of disks having the same axes and mutual distance to each other, with at least some of the disks being driven in the fleece transport direction.

The fiber fleece web may be guided in a manner that partially surrounds one of the rolls on its upper side and the adjoining roll on its lower side, so that adjoining rolls are driven in directions opposite to each other. This embodiment is equal to a turning of the fiber fleece web with respect to the successive needling processes, i.e. it is successively needled from two different sides, which is required in many cases. It is, however, also possible to only guide the fiber fleece web over the upper side of all rolls and to produce the partial surrounding by reversing rolls which are arranged in the gussets between adjoining rolls. In this case, all rolls have corresponding directions of rotation.

A distortion of the fiber fleece web is avoided when it is actively driven by the fleece support, which is especially effective if for instance at least some of the disks of a disk roll have a circumferential toothing, which may be saw-tooth-like asymmetrical or also symmetrical. It is also possible to drive at least some of the driven disks with cyclically changing circumferential velocities in that an oscillating transport motion component is superimposed to a continuous transport component. A pilgrim-step operation of the fleece web forward feed is possible in accordance with the stitching phases in case of superposition of a horizontal motion component with respect to the needle bar according to U.S. Pat. No. 5,732,453 above.

If a plurality of disk rolls are arranged in succession, it is possible to generate a fiber fleece expansion or upsetting caused by different circumferential velocities of the same.

The invention allows to mechanically compact a fiber fleece material or possibly to additionally provide it with pattern structures. The apparatus according to the invention complies with this aim in an excellent manner, since it allows to take the progress of the treatment of the fiber fleece web in the needling machine individual into account at each working position by means of individual adjustment of the needle bar movement, including the stitching depth.

This individual treatment alternative of the fiber fleece web also includes the individual selection of the types of needles. Various kinds of needles may be used: felt needles having notches of any design, so-called return needles, only active in backshaft, i.e. in the movement opposite to the stitching movement, needles having undefined notches, which only have a surface roughness, hook needles for locking stitches, crown needles and fork needles. The needles may be equal within a needle row and they may alternate. Needles notched in the forward direction may alternative with needles notched in backward direction. They may also be alternating and combined in any possible manner from needle bar to needle bar seen in the fleece progressing direction. The respective determination of the needle type and the equipment of the needle boards is determined by the person skilled in the art on the basis of the fiber fleece to be produced.

When using disk rolls as a fleece support, different toothings may be chosen at one and the same roll. The toothing may be aligned in forward or backward direction or it may be symmetrical, depending on how the toothing shall differently influence by means of motion distraction the movability of the fibers in the longitudinal direction, diagonal or in the transverse direction so that the fiber orientation of the final product can amongst others also be influenced by the disk rolls and their motion control.

The disks within one disk roller may all rotate at same speed or they may be rotated in a basic unidirectional speed to which an oscillating speed component is superimposed in a manner that within the roll the oscillating speed component of some disks is in anti-phase to the oscillating speed component of the other disks, so that deformations of the fleece are generated, which in turn change the fiber position during the stitch-in or stitch-out of the needles and thereby cause effects in view of appearance and strength values in the fleece plane.

Each individual needle or a needle pair of two needles arranged successively in the fleece transport direction may have an individual holding-down plate or two holding-down lamellae or disks which join the motion of the needle or the needle pair so that the fiber fleece web is not obstructed but basically only the stripper function is performed.

The individual velocities of rotation of the successively arranged disk rolls is preferably controllable in an infinitely variable manner. The successive disk roll may have a higher circumferential velocity for performing a fleece deformation than the preceding disk roll. For the purpose of fleece upsetting or uncovering, the disk roll velocities could also be reduced in the fleece transport direction. The needling units acting at the adjoining disk roll as fleece support can be driven at different needle bar stroke frequencies and different phase settings, wherein an infinite adjustability is favorable. As an example for an interesting phase relation the needles of the first, third, fifth, i.e. odd needle bars could simultaneously penetrate into the fleece on a disk roll at the needling unit there, whereas the needles of the even interposed needle bars penetrate into the fiber fleece at a phase offset of 180□.

Instead of the motion component of the needle bar caused by the third drive means and extending transversely to the fleece transport direction and transversely to the stitching movement, a transverse movement of the stitch support could also be realized. This technically equivalent measure, which merely exchanges the kinematics, does not have to be described in detail in view of the above statements.

It is favorable that if a plurality of disk rolls are used, these rolls are arranged in a manner that the disks of a successive disk roll are offset axially with respect to the disks of the preceding disk roll about for instance half, a quarter, an eighth etc. pitch. Thereby a full transverse coverage of the fiber fleece web through the needle penetrations at the sum of needling units is achieved.

Since the apparatus according to the invention is equipped with rotatable needles, a certain space requirement exists for the mechanics of the needle rotation drive within a needle bar, said space requirement making the needle pitches greater than usually minimally possible. Thus, only few needle rows may exist at one single needle bar, for instance only three, two or even one needle row. This requires to provide a plurality of needle bars, since then the needles of the successive needle bars are offset with respect to each other, seen in the fleece transport direction. The plurality of needle bars does make it in turn possible to more favorably take the progressing processing of the fiber fleece into account than in case of the known needle machines. In order to obtain a compact stitching pattern, i.e. a close spacing of successive needle penetrations into the fiber fleece web, the use of a roll-like support is especially favorable, since it allows to arrange successive needle penetration points in the fleece at relatively narrow spacing despite the use of voluminous drives. A plurality of such closely arranged needle bars is comparable to a group of needle bars equipped with a plurality of needle rows of earlier machines and is controllable in common motion.

The use of a plurality of disk rolls also makes it possible in a very simple manner to individually supply and needle together a plurality of fiber fleece webs, which possible have different structure, for instance different fiber orientations. This will be explained later with reference to an embodiment shown in the drawings.

SHORT DESCRIPTION OF THE DRAWINGS

The invention will now be described with reference to the drawings.

DESCRIPTION OF A PREFERRED EMBODIMENT

Figure 1:
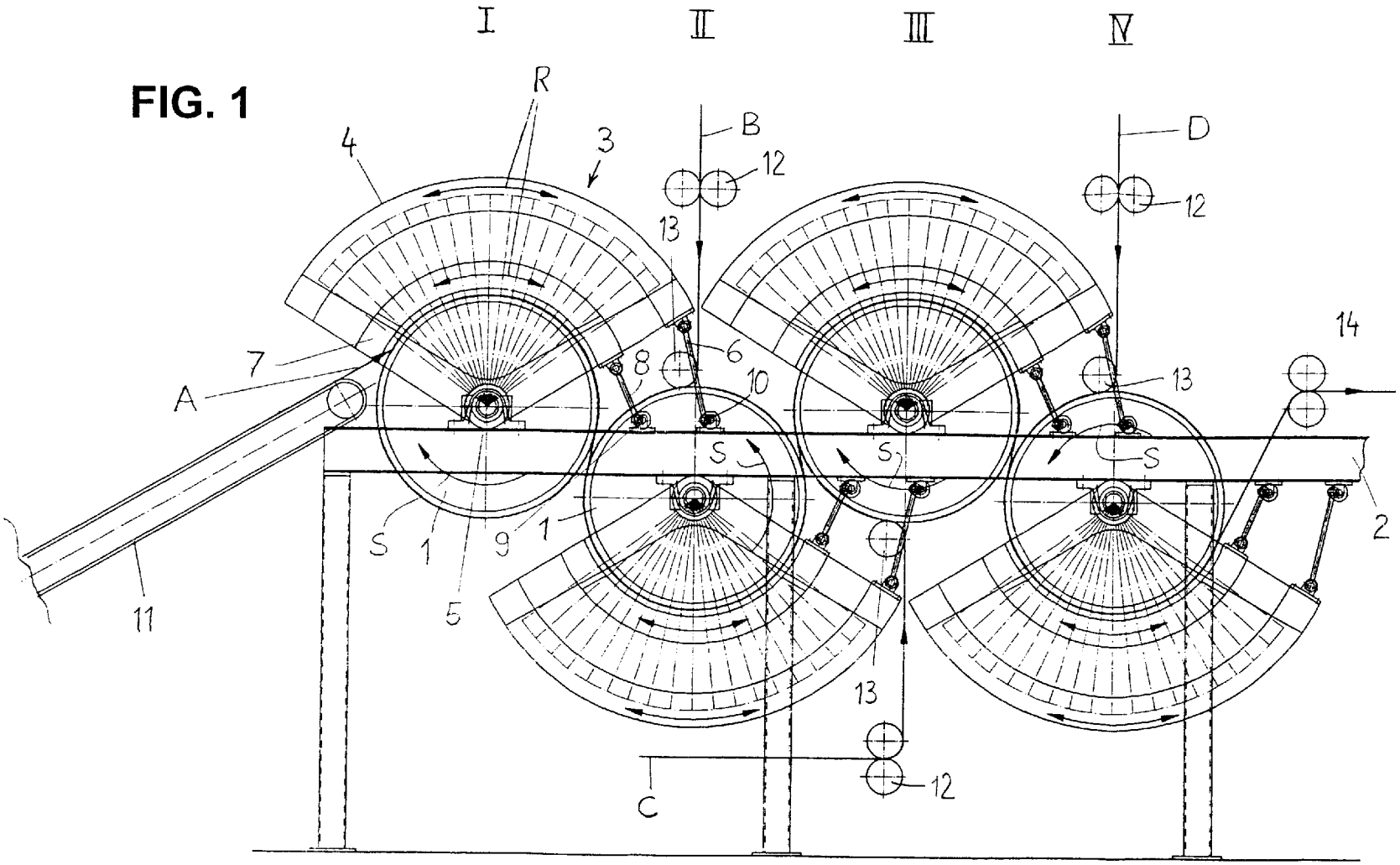
FIG. 1 is a schematic side view of the portion of an apparatus according to the invention which is necessary for explaining the invention.

FIG. 1 only shows the essential portion of a needling machine, said essential portion being addressed by the invention, namely the needling portion with a total of four needling zones I, II, III and IV. Each needling zone includes a disk roll 1 as fleece support rotatably supported in a stationary machine frame 2, and a needling unit 3 arranged at radial spacing to the disk roll 1. A fiber fleece web is successively guided over the upper side and the lower side of the successive disk rolls 1.

Each needling unit 3 comprises an outer sector frame 4, which defines a circular sector, the axis of which coinciding with the axis 5 of the disk roll 1. The outer sector frame 4 is supported at the machine frame 2 via a first link arrangement 6. The drives of a plurality of needle bars are arranged at the outer sector frame 4, said needle bars being guided by an inner sector frame 7, which basically takes the same sector angle as the outer sector frame 4. The inner sector frame 7 is supported at the machine frame 2 by means of a second link arrangement 8.

The support of the second link arrangement 8 at the machine frame 1 is carried out in the example shown via a first eccentric arrangement 9, which can be rotated via a drive (not shown) so that the inner sector frame 7 may perform a reciprocating pivotal movement around the axis 5 of the disk roll 1. The support of the first link arrangement 6 at the machine frame 1 may be fixed, since the connection of the needle bar drives to the needle bar, as generally common, is carried out via connecting rods, which are therefore able to allow a restricted mutual offset of drive and needle bar caused by the pivotal movement of the inner sector frame 7. The support of the first link arrangement 6 can, however, be performed in a manner comparable to the second link arrangement 8 also via a driven, second eccentric arrangement 10, so that the outer sector frame 4 can follow the pivotal movement of the inner sector frame 7. These pivotal movements are indicated in the drawings by the double-sided arrows R.

In FIG. 1, a supply band 11 is shown next to the left-most disk roll 1, said supply band supplying a fiber fleece web A to be processed of the first needling zone I. This fiber fleece web A is processed in the first needling zone I and discharged by same in the direction towards the second needling zone II.

As can be seen in FIG. 1, the fiber fleece web processed in the first needling zone I may be doubled by a second fiber fleece web B before being supplied to the disk roll of the second needling zone II, said fiber fleece web B being supplied from the top via supply and reversing rolls 12 and 13, respectively.

In the second needling zone the doubled fiber fleece webs A and B are needled together and are supplied from there to a third needling zone III, but before that they are doubled by a third fiber fleece web C supplied from below by another supply and reversing roll 12 and 13, respectively.

In the third needling zone III, the fiber fleece webs now consisting of three layers are needled and from there supplied to a fourth needling zone IV. Before laying it onto the disk roll of the fourth needling zone IV the three-layered, needled fiber fleece web is doubled by a fourth fiber fleece web D.

In the fourth needling zone IV the four-layered fiber fleece web is now needled and from there discharged via withdrawal rolls 14.

It must be noted that the supply of a plurality of fiber fleece webs at different locations of the machine arrangement is only an example and must not be understood in a restrictive way. Only one single fiber fleece web for instance may be processed without any doubling, or fiber fleece webs supplied in a stacked manner can be supplied to the machine via the supply band 11, or the number of needling zones may deviate from the number shown in this example.

Furthermore, it should be mentioned that in the example shown the disk rolls are driven in the transport direction of the fiber fleece web, which is characterized by arrows S.

In all four needling zones, the units necessary for needling may have the same design, they are, however, controlled according to the invention in a manner independent from one another by a central control unit (not shown) regarding their motion cycles.

It is, as described above, possible to couple either the inner sector frames 7 or the disk rolls 1 with an individual drive (not shown), respectively, which causes axial movement. The stroke thereof must, however, be adapted to the gap width between the disk of the disk roll and eventually also with the pitch of the disks in a manner that a collision of the needles with the disks is excluded.

The drive means which put the needles to the stitch and return movement, are the above-mentioned first drive means. The means causing the pivotal motion of the inner sector frame 7 are the above-mentioned second drive means, and finally, the means causing the axial movement of either the needle bars or the disk roll are the above-mentioned third drive means. The drive means for the needle rotation are fourth drive means and are described later.

Figure 2:
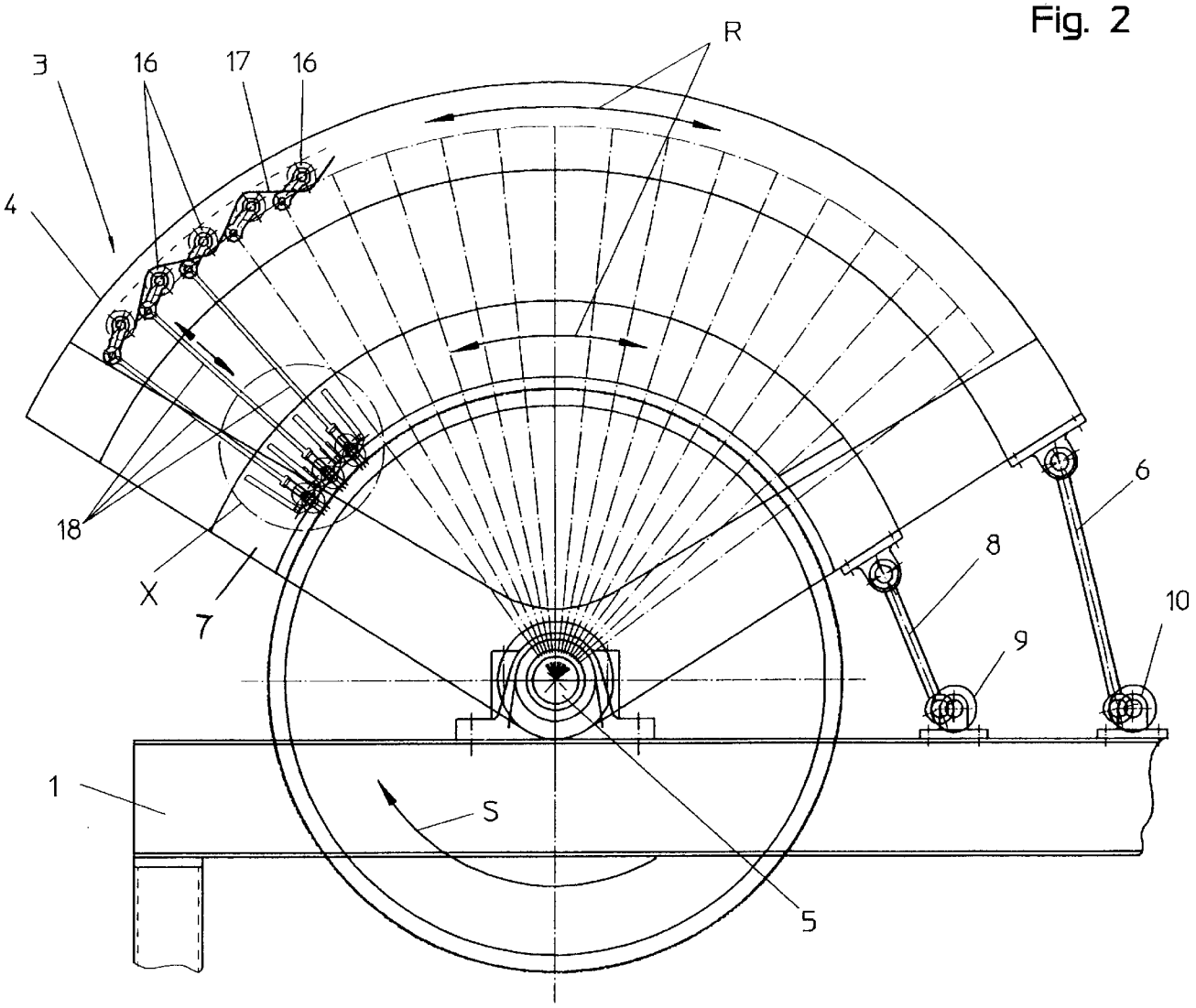
FIG. 2 shows a detail of FIG. 1 in enlarged scale.
Figure 3:
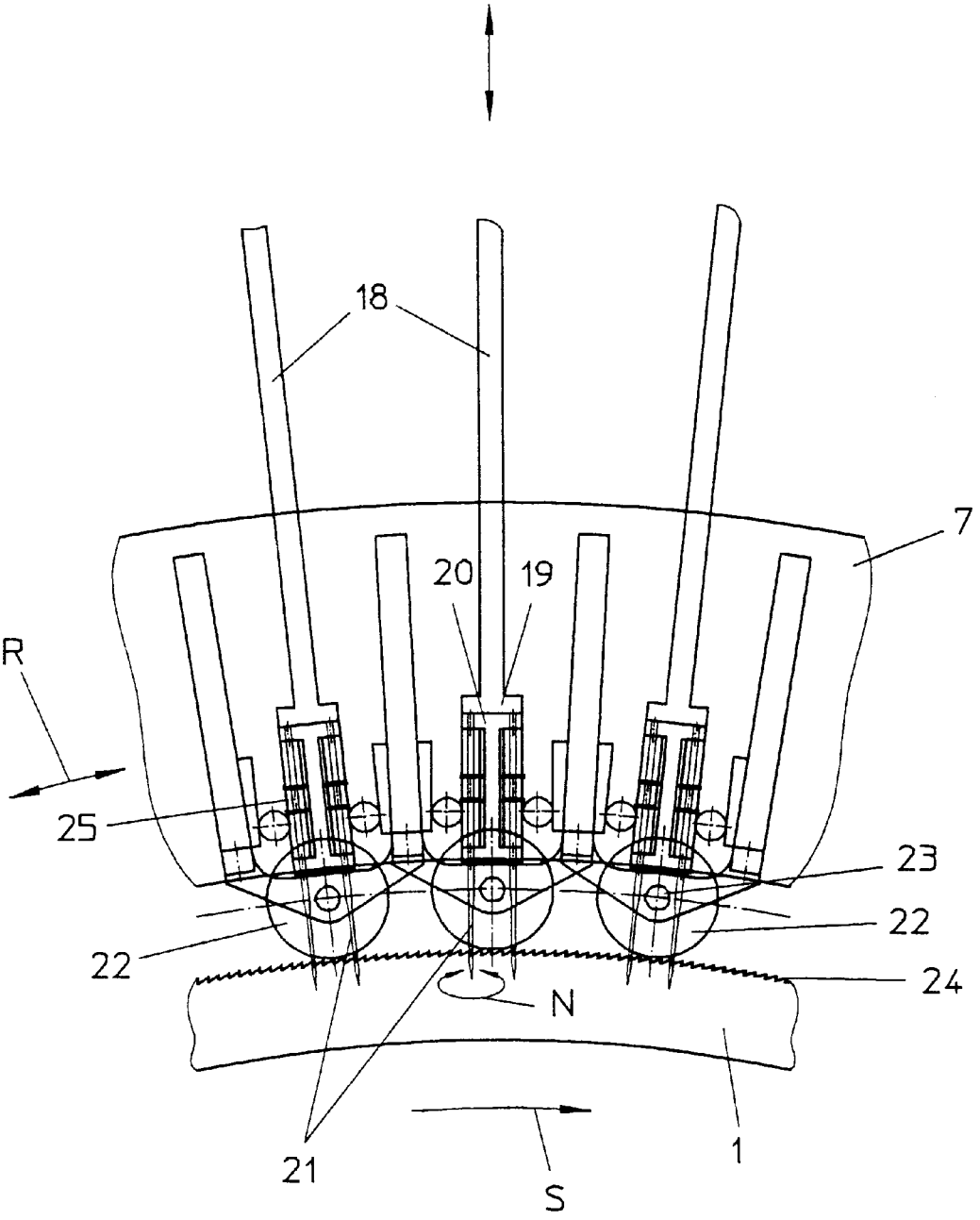
FIG. 3 shows a section of an enlarged schematic view of the needling zone as a detail of FIG. 2.

FIG. 2 shows in a scale enlarged with respect to FIG. 1 a section of FIG. 1. It shows in addition to FIG. 1 a needling unit 3 composed of drive means 15 which form the above-mentioned first drive means and which are supported at the outer sector frame 4, and which are in this case shown as cam shafts 16 which are driven by a common driving belt 17. This driving belt 17 partially encompasses adjoining crank shafts 16 in an opposite direction so that they perform rotations opposite to each other which facilitates mass compensation. It is, however, also possible to drive the crank shafts in the same direction, e.g. via a belt guide adapted accordingly or via intermediate gears or the like. The crank shafts 16 are each connected to a respective needle bar 19 via a connecting rod 18. The entirety of needle bars 19 of the needling unit 3 is radially movably supported at the inner sector frame 7. Details are shown in FIG. 3. The drive for the drive belts 17 is not shown in FIG. 2 for reasons of simplicity.

In case the apparatus are multiplied appropriately, it is also conceivable to associate an individual drive to each individual needle bar. Then, it must be taken care that the stitching phases of the needles in the respective needling zone are matched in a manner that the transport of the fiber fleece web through the needling zone is not obstructed.

FIG. 3 shows as an enlarged section, the detail X of FIG. 2. The inner sector frame 7 can be seen which is kept at a distance with respect to the disk roll 1, with only the outer circumferential portion thereof being shown. The inner sector frame 7 holds a plurality of needle bars 19, with only three of them being shown in FIG. 3, and which are guided at the sector frame 7 radially displaceable towards the disk roll 1. A needle board 20 is attached at each needle bar 19, said needle board 20 carrying two rows of needles 21 that are parallel to each other, wherein two needles are arranged successively seen in transport direction of the fiber fleece web. In the example shown the needle bars 19 are rigidly connected to their associated connecting rods 18, which considerably simplifies the mechanic design, the connecting rods 18 could, however also be pivotally attached to the needle bars 19.

In the embodiment according to FIG. 3, the holding-down device, which at the same time fulfills the fiber stripper function, is formed by a plurality of disks 22, wherein at least one such disk 22 is arranged between two needle pairs. The disks 22 associated to a needle bar 19 are held in an axis 23 at the inner sector frame 7 and can be freely rotatable in order not to obstruct the transport of the fiber fleece web, they may, however, be driven to actively contribute to the transport of the fiber fleece web.

In the embodiment shown, the disk roll 1 has an asymmetric, saw-tooth like toothing 24 at its circumference, which promotes the transport of the fiber fleece web through the needling zone, in case of an appropriate drive of the disk roll, shown in the drawings by arrow S.

Drive means 25 are arranged between the needle bar 19 and the needle boards 20, said drive means setting the needles 21 into rotation. These drive means 25 may be formed by cam guides, which engage the needles 21 rotatably supported in the needle boards 20, and which during the stitching motion of the needles 21 rotate same in the one direction and during the return motion of the needles 21 rotate same in the other direction about their axis.

Different drive means are, however, also conceivable, which are in particular effective and controllable independently of the needle stitching-in and pulling-out motion of the needle bars. Then it is possible in a simple manner to adjust the angles of rotation during stitching-in and pulling-out the needles in a manner different to one another, which may be required in some cases to release the needles from the fibers grasped without undoing the generated fiber twisting. A rotary drive means may for instance be arranged in the needle bar which comprises a plurality of rotatably supported coupling disks toothed at their circumference, each having an opening for positively receiving the shaft of a needle. These receiving openings may have a polygonal cross section, which is matched to a corresponding prismatic shape of the needle shaft, wherein a tooth rack that is driven by a motor (not shown and arranged within the needle bar) drives the coupling disks.

The needle rotation in the two above-mentioned directions is indicated in FIG. 3 by the double-arrow N. These drive means 25 for the rotary motion of the needles represent the above-mentioned fourth drive means.

What is claimed is:

1. A method for needling a fiber fleece, which is lying on a support which comprises:

cyclically penetrating the support, substantially perpendicularly to the support, with a plurality of needles, each of said needles having a needle axis and having a surface adapted to grasp fibers from said fiber fleece when moving through said fiber fleece;

grasping with the needles sections of individual fibers of said fiber fleece and offsetting these fiber sections substantially perpendicularly to the support through the fiber fleece;

rotating the needles about their axes at least during a stitching-in motion phase in which they penetrate into the fiber; and needling the fiber fleece in a plurality of successive needling zones, wherein in one zone the needles of a first kind grip the fibers of the fiber fleece when penetrating same, and in the directly adjoining zone the needles of a second kind grasp of the fibers of the fiber fleece when being pulled out of the fiber fleece.

2. A method as claimed in claim 1, further comprising:

rotating the needles in one direction of rotation during their stitching-in motion phase and in an opposite direction of rotation during a pull-out motion thereof.

3. A method as claimed in claim 2, wherein the rotations have turning angles which are different to one another in the stitching-in motion and the pull-out motion.

4. An apparatus for needling a fiber fleece web, said apparatus comprising a fiber fleece support, a needling unit having at least one needle bar extending in parallel to the fiber fleece support and carrying at a bottom side facing the fiber fleece support a needle board equipped with rotatably supported needles each having an axis of rotation and projecting toward the fiber fleece support, and first drive means which set the needle bar into an oscillating stitching-in and pulling-out motion directed perpendicular to the fiber fleece support, and a rotary drive means which sets the needles to a rotary motion around their axes of rotation, the rotary drive means being controlled such that a rotary motion of the needles at least during their stitching-in motion is caused by the first drive means wherein the rotary drive means is arranged in the needle bar and comprises a plurality of rotatable coupling disks, which comprise an opening for the positive reception of a needle shaft.

5. An apparatus as claimed in claim 4, wherein the needle shaft receiving openings have a prismatic cross section and the needles each have a shaft having a prismatic cross section matching to the cross section of said openings.

6. An apparatus as claimed in claims 4 or 5, wherein the rotary drive means is connected to a control means which enables an influence of the needle rotational motion independent of the stitching motion of the needles.

7. An apparatus as claimed in claims 4 or 5, wherein the needles are set into a cyclically reciprocating rotary motion.

8. An apparatus as claimed in claims 4 or 5, wherein the fiber fleece support is one of a driven brush roll and circumferential rib roll, and the needling unit comprises a plurality of needle bars closely spaced in the circumferential direction of the roll, said needle bars being driven in needle stitching-in and pulling-out motions directed radically with respect to the roll.

9. An apparatus as claimed in claim 8, wherein the circumferential rib roll is a disk roll composed of a plurality of disks arranged in mutual spacing, with the needles being aligned towards spaces between said disks.

10. An apparatus as claimed in claim 9, wherein at least some of the disks are rotary-driven disks.

11. An apparatus as claimed in claim 10, wherein at least some of the rotary-driven disks perform a cyclically slowing-down and accelerating rotation.

12. An apparatus as claimed in claim 9 wherein at least the rotary-driven disks comprise a circumferential toothing.

13. An apparatus as claimed in claim 7 further comprising a stripper between the needle board and the fiber fleece support, said stripper being formed by circular disks extending in parallel to the stitching-in motion of the needles, with at least two adjoining disks which form a needle penetration opening and at the same time form a holding-down member for the fiber fleece to be needled.

14. An apparatus as claimed in claims 4 or 5, wherein the at least one needle bar is provided with second drive means in addition to its first drive means causing the stitching-in and pulling-out motion, said second drive means setting the needle bar in a reciprocating motion which extends in parallel to the fiber fleece support and in a longitudinal direction of the fiber fleece web.

15. An apparatus as claimed in claim 8, wherein the at least one needle bar is provided with second drive means in addition to its first drive means causing the stitching-in and pulling-out motion, said second drive means setting the needle bar in a reciprocation motion which extends in parallel to the fiber fleece support and in a longitudinal direction of the fiber fleece web.

16. An apparatus as claimed in claim 14, wherein the at least one needle bar is connected to a third drive means, which sets the needle bar in a reciprocating motion extending in parallel to the fiber fleece support, said motion being orthogonal to the needle bar motion generated by the second drive means.

17. An apparatus as claimed in claims 14, wherein a control means is provided which controls all drive means independently of one another.

18. An apparatus as claimed in claim 15, wherein a control means is provided which controls all drive means independently of one another.

19. An apparatus as claimed in claim 16, wherein a control means is provided which controls all drive means independently of one another.

20. An apparatus as claimed in claim 10 wherein at least the rotary-driven disks comprise a circumferential toothing.

21. An apparatus as claimed in claim 11 wherein at least the rotary-driven disks comprise a circumferential toothing.

22. An apparatus as claimed in claim 8 further comprising a stripper between the needle board and the fiber fleece support, said stripper being formed by circular disks extending in parallel to the stitching-in motion of the needles, with at least two adjoining disks which form a needle penetration opening and at the same time form a holding-down member for the fiber fleece to be needled.

23. An apparatus as claimed in claim 9 further comprising a stripper between the needle board and the fiber fleece support, said stripper being formed by circular disks extending in parallel to the stitching-in motion of the needles, with at least two adjoining disks which form a needle penetration opening and at the same time form a holding-down member for the fiber fleece to be needled.

24. An apparatus as claimed in claim 10 further comprising a stripper between the needle board and the fiber fleece support, said stripper being formed by circular disks extending in parallel to the stitching-in motion of the needles, with at least two adjoining disks which form a needle penetration opening and at the same time form a holding-down member for the fiber fleece to be needled.

25. An apparatus as claimed in claim 11 further comprising a stripper between the needle board and the fiber fleece support, said stripper being formed by circular disks extending in parallel to the stitching-in motion of the needles, with at least two adjoining disks which form a needle penetration opening and at the same time form a holding-down member for the fiber fleece to be needled.

* * * * *